US008632026B2

(12) United States Patent
Colombo

(10) Patent No.: US 8,632,026 B2
(45) Date of Patent: Jan. 21, 2014

(54) SHREDDING MILL AND RELATIVE SHREDDING METHOD

(75) Inventor: Claudio Colombo, Varese (IT)

(73) Assignee: Colombo Giovanni SRL, Daverio (IT)

( * ) Notice: Subject to any disclaimer, the term of this patent is extended or adjusted under 35 U.S.C. 154(b) by 106 days.

(21) Appl. No.: 13/139,504

(22) PCT Filed: Dec. 10, 2009

(86) PCT No.: PCT/EP2009/066874

§ 371 (c)(1),
(2), (4) Date: Jun. 13, 2011

(87) PCT Pub. No.: WO2010/066859

PCT Pub. Date: Jun. 17, 2010

(65) Prior Publication Data

US 2011/0248107 A1 Oct. 13, 2011

(30) Foreign Application Priority Data

Dec. 11, 2008 (IT) ..... UD2008A0258

(51) Int. Cl.
*B02C 13/286* (2006.01)

(52) U.S. Cl.
USPC ..... 241/27; 241/30; 241/186.4; 241/282

(58) Field of Classification Search
USPC ..... 241/282, 186.2–186.5, 27, 30
See application file for complete search history.

(56) References Cited

U.S. PATENT DOCUMENTS

| | | | | |
|---|---|---|---|---|
| 4,664,323 | A * | 5/1987 | Ahonen et al. | 241/282 |
| 5,150,843 | A * | 9/1992 | Miller et al. | 241/27 |
| 6,094,795 | A | 8/2000 | Davenport | |

FOREIGN PATENT DOCUMENTS

| | | | |
|---|---|---|---|
| DE | 196 14 030 | A1 | 10/1997 |
| DE | 197 18 614 | C1 | 2/1999 |
| WO | WO 02/055205 | A | 7/2002 |
| WO | WO 2010/066863 | A1 | 6/2010 |

OTHER PUBLICATIONS

International Search Report and Written Opinion from International Parent Application PCT/EP2009/066874.

International Search Report and Written Opinion from co-pending filing of applicant International Publication No. WO 2010/066863A1.

* cited by examiner

*Primary Examiner* — Mark Rosenbaum

(74) *Attorney, Agent, or Firm* — Flaster/Greenberg P.C.

(57) ABSTRACT

A mill for shredding scrap, comprising a shredding chamber able to contain scrap during the shredding and having a shredding unit, an inlet pipe connected to an opening of the shredding chamber, in order to transfer the scrap toward the shredding chamber. The mill comprises first thrust means associated with the inlet pipe, selectively movable between a loading position of the scrap into the inlet pipe and one or more intermediate positions to transfer by means of thrusting the scrap toward the shredding chamber. The mill also comprises second thrust means, disposed in proximity with the inlet of the shredding chamber, selectively movable between an inactive position, in which they do not interfere with the introduction of the scrap into the shredding chamber by the first thrust means, and one or more thrust positions in which they introduce into the shredding chamber the scrap moved by the first thrust means until the scrap is in proximity with the opening.

11 Claims, 5 Drawing Sheets

SHREDDING MILL AND RELATIVE SHREDDING METHOD

BACKGROUND OF THE INVENTION

1. Field of the Invention

The present invention concerns a shredding mill and the relative shredding method for use in a waste disposal plant to shred, advantageously but not exclusively, scrap such as vehicles, trailers, waste material or other, into which the scrap is loaded and shredded in order to reduce its bulk.

In particular, the present invention allows to break up and/or shred scrap, iron or otherwise, and to reduce its volume, which can then be sent for subsequent processing, such as for example to separate the iron, plastic, glass or other materials and to subsequent recycling.

2. Description of Related Art

Shredding mills are known, for shredding and breaking up scrap, used in waste disposal plants.

Known shredding mills comprise a shredding chamber having a shredding unit, consisting for example of a plurality of shredding hammers moved by an associate motor. The shredding chamber is disposed downstream of a feed device suitable to introduce the scrap to be shredded into the shredding chamber. The feed device is usually associated with means to convey the scrap, such as a slide, and can include crushing rolls suitable to cooperate with the conveyor means in order to treat the scrap preliminarily, for example to crush it and move it forward.

One disadvantage of these known shredding mills is that, since they are fed substantially discontinuously, in that the scrap is introduced in an irregular way onto said conveyor means, for example loaded from a bucket or a conveyor belt, the feed device does not allow an efficient transfer of the scrap into the shredding chamber. It is advisable that the shredding chamber is constantly filled over time with a pre-determined amount of scrap, so that the drive motor of the shredding hammers works in the operating conditions for which it was designed and sized. This is both so as not to overload the motor and prevent possible breakages or early wear, and also to prevent the motor from idling, even for brief periods of time.

A further disadvantage of known shredding mills is that, in order to ensure an adequate and efficient feed of the shredding chamber, the conveyor slide must have a great inclination, which entails an increase in the overall bulk of the shredding plant.

A further disadvantage of known shredding mills is that portions of shredded waste can come out, suddenly and not wanted, from the shredding chamber, thus causing a problem of safety for the operators who control and supervise the plant.

BRIEF SUMMARY OF THE INVENTION

One purpose of the present invention is to achieve a shredding mill for use in a waste disposal plant which allows to feed the shredding chamber constantly, even when the introduction of scrap occurs in a temporarily discontinuous manner.

Another purpose of the present invention is to achieve a shredding mill which allows to reduce the overall bulk of the waste disposal plant, the man power needed and the relative maintenance operations.

Another purpose of the present invention is to achieve a shredding mill which allows to increase the safety of the plant against the unwanted expulsion of shredded fragments.

Another purpose is to perfect a method of shredding scrap which allows to prevent down times and/or times when it is not in use.

The Applicant has devised, tested and embodied the present invention to overcome the shortcomings of the state of the art and to obtain these and other purposes and advantages.

The present invention is set forth and characterized in the independent claim, while the dependent claims describe other characteristics of the invention or variants to the main inventive idea.

In accordance with the above purposes, a shredding mill according to the present invention comprises a shredding chamber into which the scrap is introduced and shredded by a shredding unit inside said chamber and fed by drive means.

The shredding mill according to the invention also comprises an inlet pipe, connected to an opening of the shredding chamber, into which the scrap is loaded. The shredding mill comprises first thrust means, associated with the inlet pipe, suitable to thrust the scrap introduced into the inlet pipe toward the shredding chamber. The first thrust means are selectively movable between a position for loading the scrap into the inlet pipe, and one or more intermediate or thrust positions, in which the scrap loaded into the inlet pipe is progressively thrust toward the shredding chamber.

According to one feature of the invention, the shredding mill also comprises second thrust means, disposed in proximity with the inlet pipe and selectively able to be activated so as to thrust the scrap into the shredding chamber. The second thrust means are movable between an inactive position, in which they do not interfere with access into the shredding chamber of the scrap thrust by the first thrust means, and one or more thrust positions, in which they introduce a portion of said scrap moved by the first thrust means into the shredding chamber as far as into proximity with the opening, but not yet introduced into the shredding chamber.

During the drive of the second thrust means, the first thrust means can be moved from said intermediate positions into their most retracted loading position, so as to allow the loading of a subsequent mass of scrap to be processed. We therefore have a coordinated and combined action of the first and the second thrust means which allows a substantially constant and continuous feed of the shredding chamber.

According to a variant of the present invention, the second thrust means are also movable into one or more leveling positions, so as to crush and/or lower the scrap thrust by the first thrust means, but not yet introduced into the shredding chamber, to a height consistent with the sizes of the shredding chamber.

According to a variant of the present invention, the shredding mill comprises stopping means, suitable to selectively obstruct entry by the scrap into the shredding chamber. The stopping means are selectively movable, in coordination with the first and/or second thrust means, between an open position, to allow the scrap to enter, thrust by the first or second thrust means, and a closed position in which they are disposed to obstruct the inlet pipe, stopping the introduction of scrap and thus preventing the overloading of the shredding chamber.

The second thrust means, disposed in one or more closed positions, and/or the stopping means disposed in the closed position, prevent the accidental and sudden exit of shredded portions from the shredding chamber.

According to one solution of the present invention, the second thrust means comprise a first cylindrical segment portion, associated with the inlet pipe, disposed substantially transversely to the direction of advance of the scrap in the inlet pipe. The segment portion is pivoted on its top and is suitable to rotate between its open position, in which it does not interfere with the inlet pipe, and said thrust positions obtained by means of progressive rotation so that one of its side faces thrusts the scrap disposed in the inlet pipe toward the shredding chamber.

According to another solution of the present invention, the stopping means comprise a second cylindrical segment portion associated with the inlet pipe, disposed substantially transversely to the direction of advance of the scrap in the inlet pipe. The second segment portion is pivoted on its top and is suitable to rotate between its open position, in which it is disposed in such a manner as not to obstruct the inlet pipe, and the closed position in which it is disposed with one of its lateral faces obstructing the inlet pipe in order to impede the introduction of scrap into the shredding chamber.

The present invention also concerns a method for shredding scrap. The method according to the present invention comprises a step of loading the scrap into an inlet pipe connected to a shredding chamber.

The method comprises a first thrust step in which, by means of first thrust means, selectively movable between a loading position where the scrap is loaded into the inlet pipe and one or more thrust positions, the scrap is progressively thrust into the shredding chamber.

The method comprises a shredding step in which the scrap progressively introduced into the shredding chamber is shredded by shredding means.

According to one feature of the invention, the method also comprises a second thrust step in which, by means of second thrust means movable between an inactive position in which they are disposed so as not to interfere with the advance of the scrap toward the shredding chamber, thrust by the first thrust means during the thrust step, and one or more thrust positions, in which the scrap disposed in proximity with the shredding chamber, but not yet introduced into it, is thrust into the shredding chamber. In the second thrust step, the first thrust means can also be moved into their most retracted loading position, so as to allow the loading into the inlet pipe of more scrap to be treated.

According to a variant of the present invention, if the shredding chamber is overloaded, the scrap entering the shredding chamber is stopped in the inlet pipe by means of stopping means suitable to obstruct access to the shredding chamber.

According to a further variant of the present invention, during the first thrust step, the scrap thrust by the first thrust means into the inlet pipe is crushed and/or lowered by means of the second thrust means disposed in one or more leveling positions.

BRIEF DESCRIPTION OF THE SEVERAL VIEWS OF THE DRAWINGS

These and other characteristics of the present invention will become apparent from the following description of a preferential form of embodiment, given as a non-restrictive example with reference to the attached drawings wherein.

DETAILED DESCRIPTION OF THE INVENTION

Figure 1:
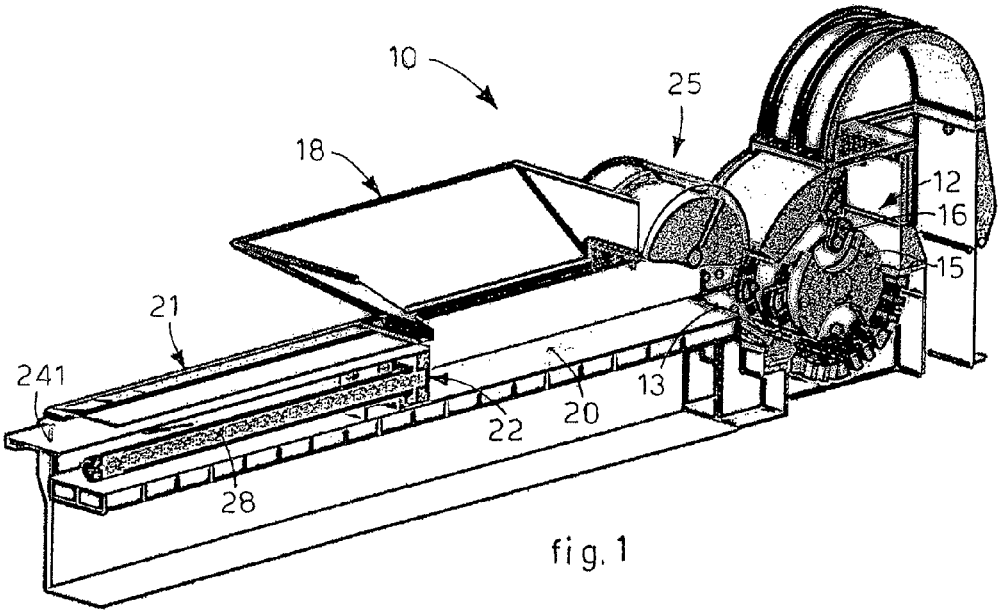
FIG. 1 is a partially sectioned perspective view of a shredding mill according to the present invention.
Figure 2:
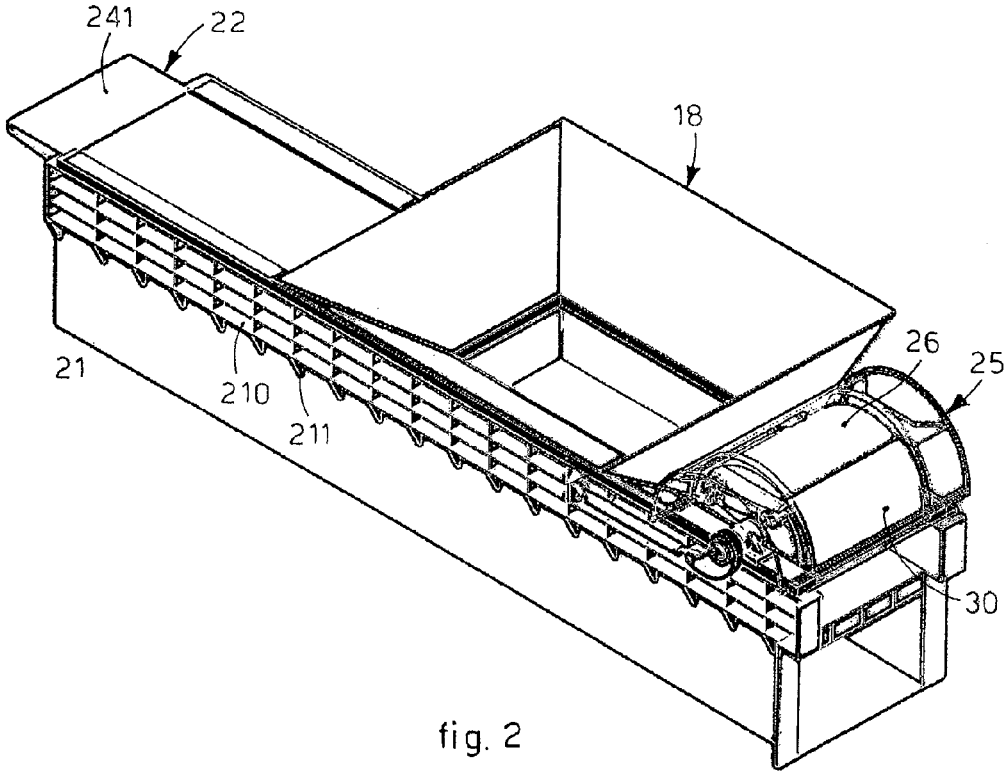
FIG. 2 is a view according to a different perspective of a detail in FIG. 1.

With reference to the attached drawings, a shredding mill according to the present invention comprises a shredding chamber 12, a shredding unit 15 disposed in the shredding chamber 12, an inlet pipe 20 for the scrap or waste 11 connected to the shredding chamber 12. The shredding mill 10 also comprises a thruster 22 able to introduce the waste 11 into the shredding chamber 12, and an auxiliary unit 25 to thrust and hold the waste. The inlet pipe 10 is also advantageously associated with a loading device, in this case a hopper 18.

The shredding unit 15, fed by electric current, is of the known type, comprising for example a plurality of rotating hammers 16.

The inlet pipe 20 is delimited by lateral walls of a box-like body 21 with which the loading hopper 18 is associated in correspondence with an upper aperture. The inlet pipe 20 has, for example, a square or rectangular cross section, and develops longitudinally and rectilinearly in a direction which defines the direction of advance of the waste 11 toward the shredding chamber 12. The lateral walls of the box-like body 21, externally to the inlet pipe, have longitudinal 210 and transverse 211 reinforcement elements, suitable to increase the resistance of the walls during the working and introduction of the waste 11 into the shredding chamber 12.

Figure 8:
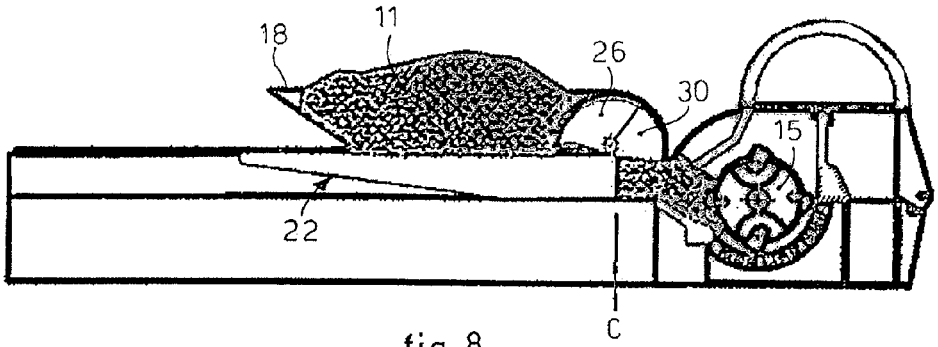
FIG. 8 is a schematic lateral view of an operating subsequent step to that in FIG. 7.

The thruster 22 is movable axially inside the inlet pipe 20 in coordination both to the current absorbed by the shredding unit 15 during the shredding of the waste 11, and also to the movement of the auxiliary thrust and hold unit 25, as will be explained in detail hereafter. The thruster 22 is suitable to thrust the waste 11 introduced through the loading hopper 18 toward the shredding chamber 12. The thruster 22 comprises a compression plate 23 disposed transversely in the inlet pipe 20, and having a square or rectangular shape mating with the section of the inlet pipe 20. The thruster 22 also comprises a movement rod 28, connected in a known manner to the compression plate 23 and driven by means of drive means, not shown in the drawings. The rod 28 allows to move the thruster 22 in the inlet pipe 20 in two opposite directions, between a loading position "A" (FIG. 3), in which the compression plate 23 is disposed so as to allow the waste 11 to be unloaded from the hopper 18 into the inlet pipe 20, and a final position "C" (FIG. 8) in which the compression plate 23 is disposed in proximity with an access opening 13 of the shredding chamber 12. The thruster 22 also comprises an upper plate 241 disposed horizontally and two lateral opposite plates 242 disposed vertically so as to protect the movement rod 28 of the thruster 22 from possible residues of waste 11 or other.

Figure 3:
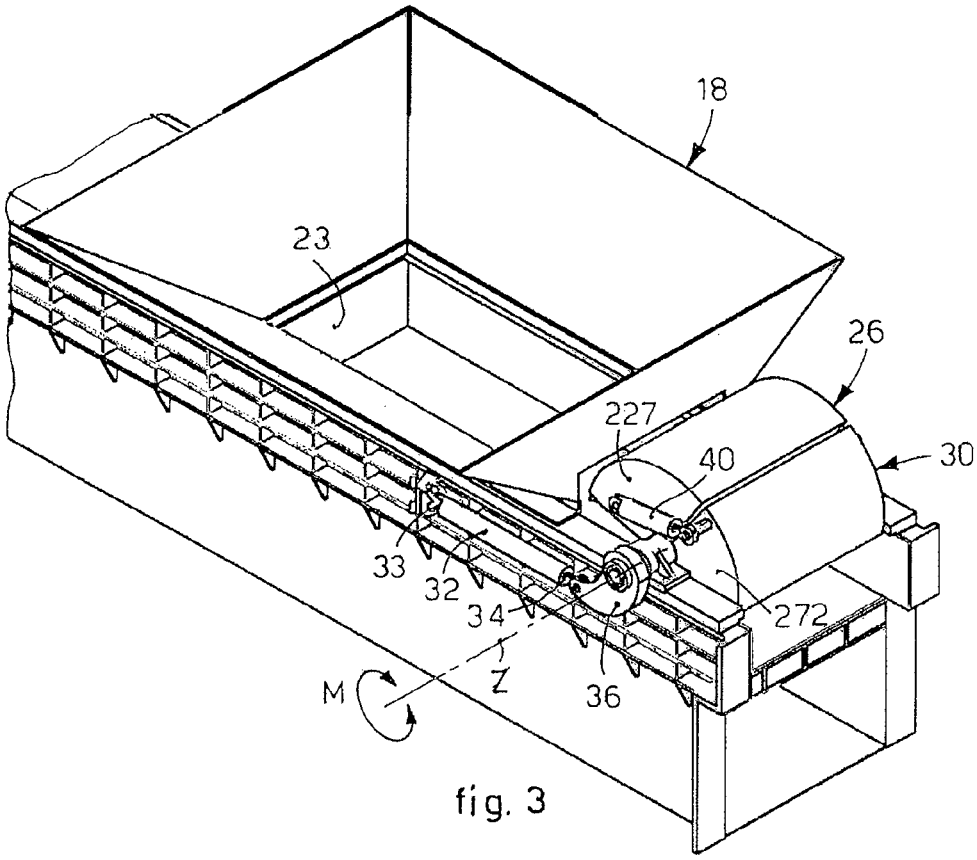
FIG. 3 is an enlarged view of a detail in FIG. 2.

The auxiliary thrust and hold unit 25, disposed in correspondence with the access opening 13 of the shredding chamber 12, comprises a presser 26 and a holding element 30 each having a body with a cylindrical segment pivoted on a top and suitable to rotate around a single axis of rotation indicated by Z in FIG. 3, in a reciprocally coordinated manner and in two opposite directions of rotation. When they are disposed adjacent, the presser 26 and the holding element 30 substantially form a semi-cylindrical body.

The presser 26 is suitable to move the waste 11 already thrust by the thruster 22 into proximity with the opening 13 and not yet introduced into the shredding chamber 12. The presser 26 is rotatable between an inactive position, in which it is disposed substantially outside the inlet pipe 20, and a plurality of thrust positions, obtained by the progressive rotation of the presser 26 in a clockwise direction, so as to thrust the waste into the shredding chamber 12 by means of a lateral face 27.

In this case, the presser 26 is moved around the axis of rotation z by means of a first actuator with a piston 32, attached at one end 33 outside the box-like body 34 and connected, at a second end 34, to an arched return arm 36 which is in turn movable rotary around the axis z. The return arm 36 is solid with the presser 26 so as to allow it to be rotated in the two opposite directions of rotation, according to a movement of extension or retraction of the first piston element 22.

Figure 5:
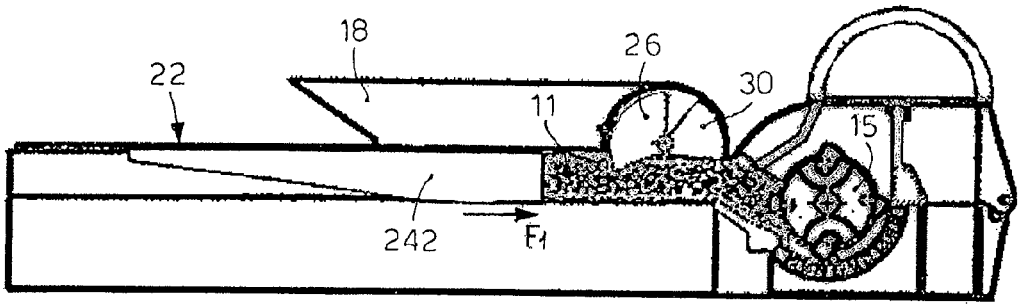
FIG. 5 is a schematic lateral view of an operating step subsequent to that in FIG. 4.

The presser 26 is also movable, again by rotation, into at least a leveling position (FIG. 5) in which it is disposed to partly block the inlet pipe 20, so as to level and/or flatten the waste 11 advancing due to the effect of the thrust of the thruster 22. The presser 26 is also movable, depending on the size detected on each occasion of the waste 11, in an oscillating manner between at least two distinct leveling positions.

The presser 26 disposed in one or more thrust positions prevents the shredded waste from accidentally and suddenly coming out of the shredding chamber 12.

Figure 4:
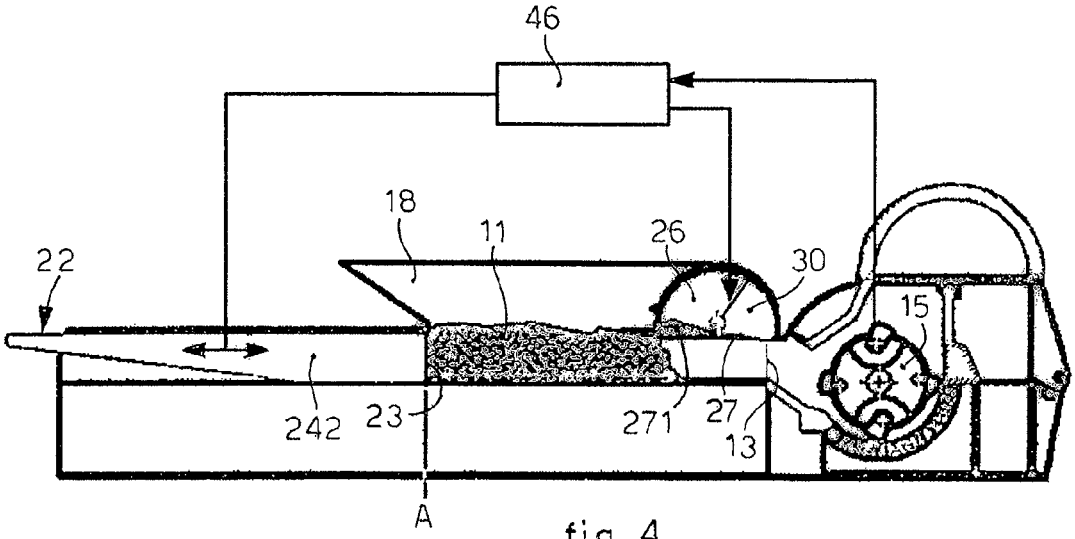
FIG. 4 is a schematic lateral view of a first operating step of the shredding mill in FIG. 1.
Figure 6:
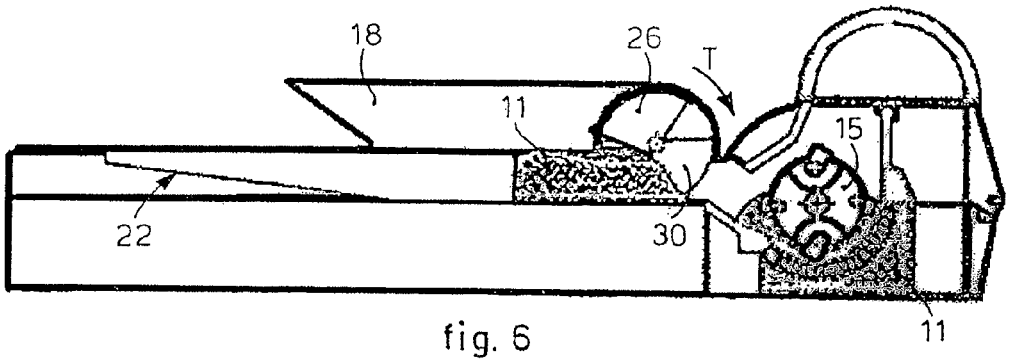
FIG. 6 is a schematic lateral view of an operating step subsequent to that in FIG. 5.
Figure 7:
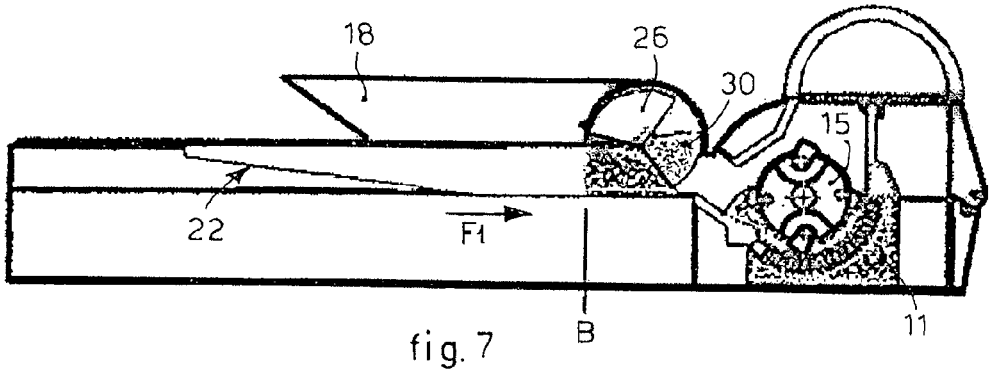
FIG. 7 is a schematic lateral view of an operating step subsequent to that in FIG. 6.

The holding element 30 is suitable to obstruct the inlet pipe 20 so as to prevent the flow of waste 11 toward the shredding chamber 12. The holding element can be rotated around the axis of rotation z between an open position (FIGS. 4 and 5) in which it is disposed substantially outside the inlet pipe, in which a lateral face 27 thereof is disposed substantially parallel to the feed surface, and a closed position, in which it is disposed with its lateral face 27 (FIG. 6) transverse to the inlet pipe 20 in order to stop the advance of the waste 11.

In this case, the holding element 30 is made to rotate around the axis z by means of second piston-type actuators 40 pivoted at the ends both to the bases 272 of the presser 26 and also to the bases 272 of the holding element 30. The extension and retraction of the second piston-type actuators 40 allows to rotate the holding element 30 while keeping the presser 26 stationary.

Therefore the holding element 30, disposed in its closed position, in practice prevents the waste shredded by the shredding chamber 12 from unexpectedly coming out, allowing to increase safety for the staff responsible for checking and supervising.

Furthermore, the disposition of the presser 26 and the holding element 30 positioned substantially between the hopper 18 and the opening 13 of the shredding chamber 12 allows to considerably reduce the sizes of the mill 10 itself, since it is no longer necessary to have a conveyor or feed slide that is particularly inclined, as in the state of the art.

The mill 10 also comprises a control and processing unit 46, suitable to drive in a coordinated manner the thruster 22, the presser 26 and the holding element 30, according to the data, detected directly or indirectly, of the absorption of energy and/or of current of the shredder unit 15.

The shredder mill 10 as described heretofore functions as follows.

The waste 11 or scrap to be shredded is introduced (FIG. 3) into the inlet pipe 20 by means of the loading hopper 18. The waste is unloaded into the hopper 18 by means of a crane, a bucket or other suitable loading means. The thruster 22 is disposed in its loading position, in which it is disposed retracted into the inlet pipe 20.

Subsequently the thruster 22 is moved axially in the inlet pipe 20, thrusting the waste 11 with the compression plate 23 toward the opening 13 of the shredding chamber 12 and then inside the chamber 12 itself. The intensity and speed of movement of the thruster 22 is coordinated with the current absorbed by the shredding unit 15. Therefore, if there is a high absorption of current, corresponding to an overload situation of the shredding chamber, the thruster 22 is slowed down or possibly stopped. When the current absorbed by the shredding unit returns within a normal functioning range, the thruster 22 is again moved.

During the movement of the thruster 22 from its loading position to its final position, the presser 26 is moved to the leveling position (FIG. 5) in order to level or flatten the waste 11 entering, or is made to oscillate periodically or according to the size of the waste 11 as detected for example by means of sensors of a known type not shown in the drawings.

When an excessive introduction of waste 11 into the chamber 12 is detected, the thruster 22 is stopped (FIG. 6), the presser 26 is made to rotate in a clockwise direction and is positioned in its inactive position. The holding element 30 is then made to rotate, by means of the second piston-type actuator 40, into its closed position, thus preventing the waste 11 from entering through the opening 13 into the chamber 12.

When the current absorbed by the shredding unit returns within a normal functioning range, that is, when the excess waste 11 in the chamber 12 has been shredded and/or disposed of, the holding element 30 is again returned to its open position and the thruster 22 is again driven in order to thrust the waste 11 into the inlet pipe 20.

When the thruster 22 reaches the intermediate position "B", where the compression plate 23 is disposed in proximity with the auxiliary unit 25, the presser 26 is positioned and kept in its open position, allowing the thruster 22 to pass.

Figure 9:
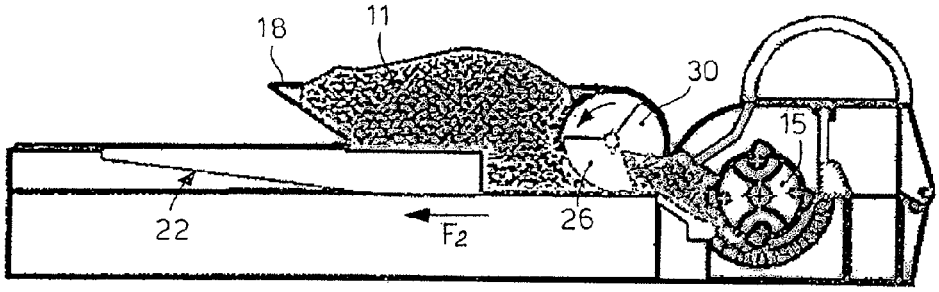
FIG. 9 is a schematic lateral view of an operating step subsequent to that in FIG. 8.
Figure 10:
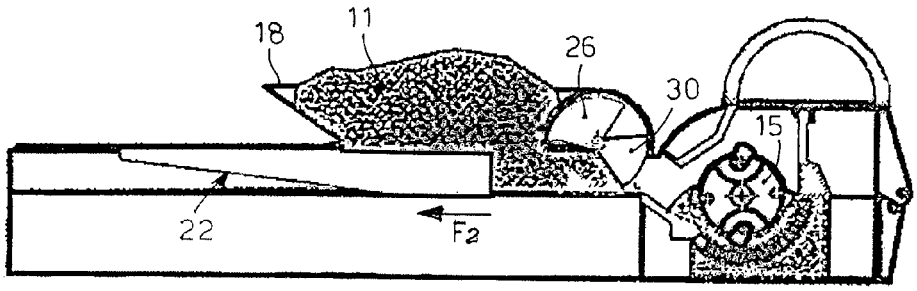
FIG. 10 is a schematic lateral view of an operating step subsequent to that in FIG. 9.
Figure 11:
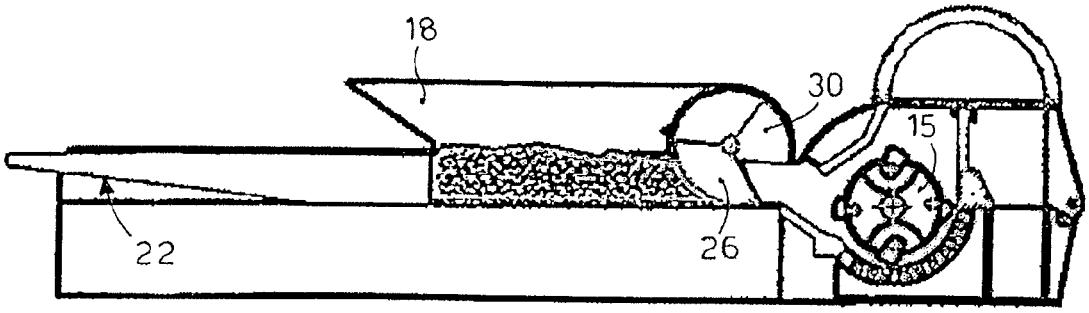
FIG. 11 is a schematic lateral view of an operating step subsequent to that in FIG. 10.

During the movement of the thruster 22 between the positions "B" and "C", the hopper 18 is filled with more waste 11 to be shredded (FIGS. 8, 9 and 10), which is held in the loading compartment of the hopper 18 because it is blocked by the upper plate 241 of the thruster 22 which thus functions as a temporary closing element of the inlet pipe 20.

When the compression plate finally reaches the final position "C", the thruster 22 is moved in the opposite direction of movement, leaving in the inlet pipe 20 a quantity of waste 11 sufficient to feed the shredding chamber during the time needed to effect a new loading of the inlet pipe 20.

At the same time the thruster 22 is moved from the final position "C" toward the loading position, the presser 26 is made to rotate in an anti-clockwise direction so as to enter into the inlet pipe 20 and thrust, with a lateral face 271, the waste 11 present near the opening 13, allowing to feed the chamber 12 also during the downtime of the returning thruster 22.

Furthermore, in the event of an overload of the feed chamber, the presser 26 is made to rotate into its inactive position while the holding element is made to rotate into its closed position, until the end of the overload conditions.

While the thruster 22 is moved into its loading position "A", the waste 11 already unloaded into the hopper 18 is progressively transferred into the inlet pipe, as the upper plate gradually retreats inside the box-like body 21.

In this way it is therefore possible to considerably reduce the presence of man power required for the control and supervision of the mill 10, and also the need for frequent maintenance operations, since the coordinated drive of the presser 26 and of the holding element 30 in practice prevents jamming and/or blockages due to overloading of the shredding unit 15.

It is clear that modifications and/or additions of parts may be made to the shredding mill 18 as described heretofore, without departing from the field and scope of the present invention.

It is also clear that, although the present invention has been described with reference to some specific examples, a person of skill in the art shall certainly be able to achieve many other equivalent forms of shredding mill, having the characteristics as set forth in the claims and hence all coming within the field of protection defined thereby.

I claim:

1. A mill for shredding scrap, comprising a shredding chamber able to contain scrap during the shredding and having a shredding unit, an inlet pipe connected to an opening of said shredding chamber, in order to transfer said scrap toward said shredding chamber, first thrust means associated with said inlet pipe, selectively movable between a loading position of said scrap into said inlet pipe and one or more intermediate positions to transfer by means of thrusting said scrap toward the shredding chamber, the mill comprising second thrust means, disposed in proximity with the inlet of the shredding chamber, selectively movable between an inactive position, in which they do not interfere with the introduction of said scrap into the shredding chamber by said first thrust means, and one or more thrust positions in which they introduce into the shredding chamber the scrap moved previously by said first thrust means in proximity with said opening, wherein said second thrust means comprise a first cylindrical segment portion, disposed transversely to the direction of advance of the scrap in the inlet pipe, pivoted on one of the tops thereof and suitable to rotate between said inactive position, in which said first cylindrical segment portion is disposed outside the inlet pipe, and said thrust positions in which said first cylindrical segment portion is disposed in such a manner that one of the lateral faces thereof thrusts the scrap from the inlet pipe toward the shredding chamber.

2. The mill as in claim 1, comprising stopping means, selectively movable, in a manner coordinated with the movement of said first and/or second thrust means between an open position, able to not interfere with the transfer of said scrap, thrust by the first or second thrust means into the shredding chamber, and a closed position in which they are disposed to obstruct the inlet pipe in order to prevent an overloading of the shredding chamber.

3. The mill as in claim 2, wherein said stopping means comprise a second cylindrical segment portion, disposed transversely to the direction of advance of the scrap in the inlet pipe, wherein said second cylindrical segment portion is pivoted on one of the tops thereof and is able to rotate, in a manner coordinated with the rotation of the first cylindrical segment portion, between said open position, in which said second cylindrical segment portion is disposed in such a manner as not to obstruct the inlet pipe, and the closed position in which said second cylindrical segment portion is disposed with one of the lateral faces thereof obstructing the inlet pipe.

4. The mill as in claim 3, wherein said first and second cylindrical segment portions rotate around a single axis of rotation transverse to said direction of advance.

5. The mill as in claim 2, comprising a control unit able to drive in a coordinated manner said first and second thrust means and said stopping means, on the basis of a direct or indirect detection of the absorption of energy of the shredding unit.

6. The mill as in claim 1, wherein said second thrust means are also movable into one or more leveling positions, able to lower the scrap thrust by the first thrust means to a height consistent with the sizes of the shredding chamber.

7. A waste disposal plant comprising a shredding mill as in claim 1.

8. A method for shredding scrap comprising:

a loading step in which the scrap is loaded into an inlet pipe connected to an opening of a shredding chamber;

a first thrust step in which, by means of first thrust means, selectively movable between a loading position where the scrap is loaded into the inlet pipe and one or more thrust positions, the scrap is progressively thrust toward the shredding chamber; and a shredding step in which the scrap progressively introduced into the shredding chamber is shredded by shredding means, the method further comprising a second thrust step in which, by means of second thrust means, movable between an inactive position in which they are disposed so as not to interfere with the transfer into the shredding chamber of scrap thrust by the first thrust means and one or more thrust positions, the scrap previously thrust by said first thrust means into proximity with said opening is thrust into the shredding chamber, wherein said second thrust means comprise a first cylindrical segment portion, disposed transversely to the direction of advance of the scrap into the inlet pipe, pivoted on one of the tops thereof and suitable to rotate between said inactive position and said thrust positions, and wherein said first cylindrical segment portion is disposed in such a manner that one of the lateral faces thereof thrusts the scrap from the inlet pipe toward the shredding chamber in said second thrust step.

9. The method as in claim 8, wherein in said second thrust step the first thrust means are moved toward the loading position so as to allow the loading into the inlet pipe of other scrap to be shredded.

10. The method as in claim 8, wherein the scrap entering into the shredding chamber is stopped in the inlet pipe by stopping means, selectively movable, in a manner coordinated with the movement of said first and/or second thrust means between an open position, able to not interfere with the transfer of said scrap thrust by the first or second thrust means into the shredding chamber, and a closed position in which they are disposed to obstruct the inlet pipe in order to prevent an overloading of the shredding chamber.

11. The method as in claim 8, wherein in said first thrust step, the scrap thrust by said first thrust means into the inlet pipe is crushed and/or lowered by said second thrust means, disposed in one or more leveling positions, to a height consistent with the sizes of the shredding chamber.

* * * * *